United States Patent [19]

Popescu

[11] Patent Number: 4,536,261

[45] Date of Patent: Aug. 20, 1985

[54] ALKALINE BATH FOR THE ELECTRODEPOSITION OF BRIGHT ZINC

[76] Inventor: Francine Popescu, 94490 Ormesson, France

[21] Appl. No.: 638,435

[22] Filed: Aug. 7, 1984

[51] Int. Cl.[3] ..... C25D 3/22

[52] U.S. Cl. ..... 204/55 R

[58] Field of Search ..... 204/55 R, 55 Y, 44.2, 204/114

[56] References Cited

U.S. PATENT DOCUMENTS

| | | | |
|---|---|---|---|
| 3,974,045 | 8/1976 | Takahashi et al. | 204/55 R |
| 4,045,306 | 8/1977 | Senge et al. | 204/55 R |
| 4,146,442 | 3/1979 | McFarland | 204/55 R X |
| 4,166,778 | 9/1979 | Acimovic et al. | 204/55 R |
| 4,169,771 | 10/1979 | Creutz et al. | 204/55 R |
| 4,169,772 | 10/1979 | Lowery et al. | 204/55 R |
| 4,188,271 | 2/1980 | Eckles et al. | 204/55 R |
| 4,397,717 | 8/1983 | Acimovic et al. | 204/55 R X |

*Primary Examiner*—G. L. Kaplan

*Attorney, Agent, or Firm*—Gifford, VanOphem, Sheridon, Sprinkle & Nabozny

[57] ABSTRACT

A zinc electroplating bath comprising as a brightener additive a reaction product of an heterocyclic pentagonal or hexagonal compound with a cyclic carbonate; the ensuing product is then reacted with an epihalohydrin or an alpha-dihalohydrin which ensuing product is then reacted with a compound of the general formula

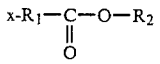

wherein x represents a hydrogen atom or a phenyl radical;

$R_1$ represents an alkenylene, alkylene, haloalkenylene, hydroxyalkenylene or carboxy (hydroxy) alkenylene group; and $R_2$ represents a hydrogen atom or an alkyl, hydroxyalkyl, haloalkyl or halohydroxyalkyl group.

21 Claims, No Drawings

ALKALINE BATH FOR THE ELECTRODEPOSITION OF BRIGHT ZINC

BACKGROUND OF THE INVENTION

This invention relates to the electrodeposition of bright zinc from alkaline, aqueous, zinc electroplating baths and to brighteners and additives to be used in such baths.

SUMMARY OF THE PRESENT INVENTION

Many brighteners and additives are known for obtaining a bright zinc deposit in an alkaline zinc electroplating bath. Examples are described in the German Pat. Nos. DT 2412356, DT 2712515 and in the French Pat. No. 2.423.557; in these cited patents are discovered brighteners prepared from heterocyclic pentagonal or hexagonal compounds including at least two nitrogen atoms in the ring.

One inconvenience of the known brighteners prepared from these heterocyclic compounds is that they provide zinc deposits which are non uniform in structure over a range of the cathodic current densities used in practice and, namely, produce zinc deposits presenting streaks and pittings.

The bath and the process of the present invention supersedes such inconvenience of the prior art, by allowing the production of bright and uniform zinc electrodeposits, presenting no streaks or pittings, under a wide range of current densities.

According to one aspect of this invention, it has been found that bright, ductile and uniform zinc electrodeposits, without streaks or pitting, may be obtained from an alkaline, non cyanide, zinc plating bath containing an effective amount of a water soluble nitrogen-containing polymer, compatible with said bath, said polymer being obtained by the three successive chemical reactions A, B and C, as follows:

Reaction A: An heterocyclic pentagonal or hexagonal compound, comprising at least two nitrogen atoms in the aromatic ring, is reacted with a cyclic carbonate comprising carbon, hydrogen and oxygen atoms;

Reaction B: The product of the reaction A is further reacted with an epihalohydrin or an alpha-dihalohydrin, in order to obtain a water soluble nitrogen-containing polymer;

Reaction C: The product of reaction B is further reacted with a compound of general formula (1):

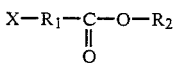

(1)

wherein:

X represents a hydrogen atom or a phenyl radical;

$R_1$ represents an alkenylene, alkylene, haloalkenylene, hydroxyalkenylene or carboxy (hydroxy) alkenylene group; and $R_2$ represents a hydrogen atom or an alkyl, hydroxyalkyl, haloalkyl or halohydroxyalkyl.

The reactions A, B and C are realized, preferably, in aqueous media or in a polar solvent.

The aqueous solution of the nitrogen-containing polymer obtained by the successive reactions A, B and C is utilized, according to this invention, as brightener for alkaline zinc electroplating baths.

DESCRIPTION OF THE PREFERRED EMBODIMENT

The heterocyclic pentagonal or hexagonal compounds which may be used for the reaction A are the following: imidazole, pyrrole, piperazine, benzotriazole and their derivatives of substitution at their carbon or nitrogen atoms.

Here are some preferred compounds: imidazole, 1-methylimidazole, 2-methylimidazole, 1-hydroxyethylimidazole, 2-hydroxyethylimidazole, 2,4-dimethylimidazole, 1,2-dimethylimidazole, 2-ethylimidazole, 2-ethyl-4(5)-methylimidazole, 2-isopropylimidazole, 2-phenylimidazole, 1-(3-aminopropyl)imidazole, 1-(3-dimethylaminopropyl)imidazole, pyrrole, 2,5-dimethylpyrrole, piperazine, 1-ethylpiperazine, 1-(2-hydroxyethyl)piperazine.

The cyclic carbonates which may be utilized for the reaction A have the general formula:

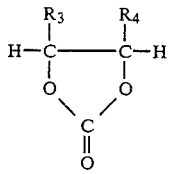

(2)

wherein:

$R_3$ and $R_4$ are, independently one of another, a hydrogen atom or an alkyl group, or the group $R_5OCH_3$— wherein $R_5$ is hydrogen or alkyl, and $R_3$ and $R_4$ may represent together an alkylene radical comprising at least two carbon atoms.

Examples of cyclic carbonates according to formula (2) are: ethylene carbonate, propylene carbonate, glycerol carbonate, allylglycerol carbonate, 2,3-butylene carbonate and phenylene carbonate. The reaction between the heterocyclic compounds comprising two nitrogen atoms, described above, and one or several cyclic carbonates of formula (2) is realized, preferably, in aqueous media, at a pH comprised between 7 and 10 and at a temperature of 80° to 100° C.

The molar ratio between the nitrogen containing heterocyclic compound and the cyclic carbonate is comprised, preferably, between 1/1 and 1/10. The reaction time is 30 to 120 minutes.

At this stage of the invention, the product resulting from the reaction A is not exactly known, but it is presumed that this product is a mixture of carbamates of the type:

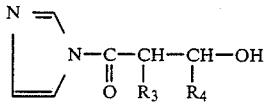

with N-hydroxylated compounds of the type:

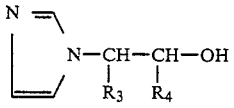

Reaction B

According to the present invention, the products resulting from the Reaction A are further reacted with an epihalohydrin or an alpha-dihalohydrin. Epichlorohydrin or alpha-dichlorohydrin is preferably utilized and is gradually added to the aqueous solution obtained from reaction A, at a temperature comprised between 40° and 100° C., the reaction time being of 1 to 3 hours.

The molar ratio between the heterocyclic compound of the reaction A and the epihalohydrin or the alpha-dichlorohydrin is chosen between 5/1 to 1/1.5. The pH is maintained between 6.5 and 10, during the reaction.

Reaction C

After the reaction is accomplished, the aqueous solution obtained is, according to this invention, further reacted with a compound of formula (1).

The Table I gives some non limiting examples of compounds of formula (1):

TABLE I

| COMPOUND OF FORMULA (1) |
|---|
| 1°/ $Cl-CH_2-CO.ONa$ |
| 2°/ $CH_2-CH-CO.O-CH_2-CH_2-OH$ |
| 3°/ $CH_2=CH-CO.OH$ |
| 4°/ $CH_3-\underset{\underset{Cl}{\vert}}{CH}-CO.O-CH_2-CH(OH)-CH_2-Cl$ |
| 5°/ $HO-CH_2-CO.O-CH_2-CH(OH)-CH_2-Cl$ |
| 6°/ $C_6H_5-CH_2-CO.O-CH_2-CH(OH)-CH_2-Cl$ |
| 7°/ $CH_2(COOH)-C(OH)(COOH)-CH_2-CO.O-CH_2-CH(OH)-CH_2-Cl$ |

The compound of formula (1) is added to the aqueous solution resulting from the successive reactions A and B in a proportion of 0.5 to 15.0 percent of the total mass of reactants.

This reaction takes place at a temperature of 80° to 105° C. and at a pH of 7 to 9. The reaction time is 1 to 3 hours.

The final aqueous solution of polymer, obtained by the successive reactions A, B and C, is utilized as brightener for alkaline zinc electroplating according to this invention.

For practical reasons, this solution is diluted with water to a concentration of 10 to 20 percent of active matter.

In accordance with another aspect of this invention, one may realize certain variants of the above described reactions, namely of the reaction B, with the scope of modifying the structure of the nitrogen-containing polymer obtained by these reactions.

Following a preferred embodiment of the invention, the product of the reaction A is mixed with other compounds able to react with the epihalohydrin or the alpha-dihalohydrin, before being put in reaction B, namely with cyclic or aliphatic amines or polyamines comprising at least one primary or secondary nitrogen atom.

Examples of aminated compounds which may be associated with the products of the reaction A, in performing the reaction B, are the following: methylamine, ethylamine, dimethylamine, diethylamine, isopropylamine, ethylenediamine, diethylenetriamine, tetraethylenepentamine, 1,2-dimethylpropylamine, di-n-propylamine, N-methylpropylamine, 2-methoxyethylamine, cyclohexylamine, 2-diethylaminoethylamine, methylethanolamine.

The proportion of the amine added to the product of the reaction A may vary between 0.5 to 50.0 percent of the mass of the heterocyclic compound used in reaction A.

It is obvious that a supplementary quantity of epihalohydrin or alpha-dihalohydrin is to be added, in the reaction B, in order to react with the amine, a preferred ratio being the equimolar.

The following examples illustrate, in a non limiting manner, the preparation of the nitrogen containing polymers which may be utilized, according to this invention, as zinc electroplating brighteners.

EXAMPLE 1

Reaction A: 68.1 g imidazole, 300 g water, 5 g potassium carbonate and 40 g ethylene carbonate are introduced in a reaction vessel and heated, under reflux and stirring, at 80° C. during one hour and at 100° C. during two hours.

Reaction B: The product of the reaction A is cooled at 50° C. and 92.0 g of epichlorohydrin are added under stirring, drop by drop. The solution is then heated under reflux at 100° C. during two hours.

Reaction C: To the polymer solution obtained in reaction B, there are added 8 g of compound No. 5 of Table 1. The mixture is heated under stirring at the reflux temperature during two hours, the pH of the solution being maintained, during the reaction, at 7.5–8.5 by additions of a 50% solution of sodium hydroxide in water.

The solution of nitrogen containing polymer resulting from the reactions A, B and C is diluted with water to a concentration of 20% of active matter and is utilized as alkaline zinc electroplating brightener according to this invention.

EXAMPLE 2

Reaction A: 40.8 g imidazole, 8.2 g 1-metylimidazole, 6.7 g pyrrole, 300 g water, 4 g potassium carbonate, 35 g ethylene carbonate and 10 g propylene carbonate are introduced in a reaction vessel. The mixture is heated under reflux and stirring one hour at 80° C. and 3 hours at 100° C.

Reaction B: The product of reaction A is cooled at 50° C. and 85 g epichlorohydrin are added, drop by drop with stirring, followed by 5 g alpha-dichlorohydrin. The solution is then heated at 100° C. during 3 hours, under reflux and stirring.

Reaction C: To the polymer solution obtained by the reaction B, there are added 6 g of compound No. 1 and 3 g of compound No. 7 of Table 1. The reaction mixture is heated at 100°–105° C. under reflux and stirring, the pH of the solution being maintained at 7.5–8.5 by additions of a 50% solution of sodium hydroxide.

The resulting solution of nitrogen-containing polymer is diluted with water to a concentration of 20% active matter and is utilized as alkaline zinc electroplating brightener as per this invention.

EXAMPLE 3

Reaction A: 61.2 g imidazole, 8.2 g 2-methylimidazole, 300 g water, 5 g potassium carbonate and 40 ethylene carbonate are introduced in a reaction vessel and heated, under stirring and reflux, at 80° C. during one hour and at 100° C. during two hours.

Reaction B: The product of reaction A is cooled at 50° C. and then, under stirring, there are added 13 g dimethylamine and (slowly) 117 g epichlorohydrin. THe solution is then heated at 100° C. during two hours, under reflux and stirring.

Reaction C: To the polymer solution remaining from reaction B, there are added 5 g of compound No. 4 and 4 g of compound No. 5 of Table 1. The mixture is heated two hours at 100°–105° C. maintaining the pH at 7.5–8.5 by 50% sodium hydroxide additions.

The resulting solution of nitrogen-containing polymer is diluted with water at a concentration of 20% active matter and is utilized as zinc electroplating brightener, according to this invention.

The zinc electroplating baths which are the object of this invention consist of an aqueous solution of an alkaline zincate, like the sodium or potassium zincate, in presence of an excess of alkaline hydroxide (e.g. sodium or potassium hydroxide) and may comprise, eventually, an alkaline cyanide, although the principal object of this invention is to provide cyanide free alkaline zinc electroplating baths.

The concentration of zinc in these baths is usually comprised between 5 and 20 grams per liter of bath, and the concentration of the alkaline hydroxide between 70 and 200 g/l.

Apart from the basic constituents mentioned above, the electroplating baths of this invention comprise, in solution, an effective amount of one or several nitrogen-containing polymers, in conformity with those described above, the total concentration of these polymers being comprised between 0.5 and 50.0 grams per liter of bath.

According to another aspect of this invention, the nitrogen-containing polymers described above are associated, in the zinc plating bath, with one or several secondary brighteners or additives, with the purpose to enhance the brilliance or the bright plating range of the zinc electrodeposits obtained from these baths.

As secondary additives, one may utilize aromatic aldehydes, phenol aldehydes, quaternary pyridinium derivatives, quaternary derivatives of nicotinic acid, the reaction products of aromatic aldehydes with amines and, also, some natural or synthetic water soluble polymers, known in the art, such as polyvinyl alcohol, various qualities of glues, gums and gelatins, the homopolymers of acrylamide, or the homopolymers of acrylic acid. The concentration range of these secondary additives, in the zinc plating bath, is from 0.05 to 10.0 grams per liter of bath.

The Table 2 gives nonlimiting examples of secondary additives which may be advantageously associated with the nitrogen containing polymers of this invention.

TABLE 2

SECONDARY ADDITIVES

| Compound | Optimal concentration in the zinc plating bath g/l |
|---|---|
| 1° BENZOIC ALDEHYDE | 0.1–1.5 |
| 2° o- and p-METHOXYBENZALDEHYDES | 0.1–1.5 |
| 3° o-,m- and p-HYDROXYBENZALDEHYDES | 0.1–1.5 |
| 4° VANILLIN | 0.1–0.5 |
| 5° HELIOTROPIN | 0.1–1.5 |
| 6° VERATRALDEHYDE | 0.1–0.8 |
| 7° 1-BENZYL-PYRIDINIUM-3-CARBOXYLATE | 0.05–1.5 |
| 8° SODIUM POLYACRYLATE | 0.5–5.0 |
| 9° The quaternary compound: 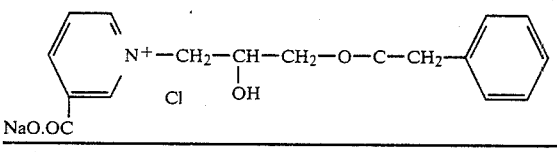 | 0.05–1.8 |

The following examples show zinc electroplating baths in conformity with the invention:

EXAMPLE 4

A stock of basic solution of alkaline zinc plating bath of the following composition is prepared:

| | |
|---|---|
| Sodium hydroxide | 110 g/l |
| Zinc oxide | 12 g/l |

The sodium hydroxide and zinc oxide, of pure quality, are dissolved in water to form an alkaline solution of sodium zincate, comprising about 9.5 g/l of zinc metal.

In this bath, there are added the additives as per the following examples, to obtain bright zinc electrodeposits:

EXAMPLE 5

In the bath of example 4 there is added:

| | |
|---|---|
| Nitrogen-containing polymer solution obtained as per Example 1 | 20 ml/l |

Under a cathodic current density of 0.1 to 3.0 A/dm$^2$ and at a bath temperature of 20° to 35° C., there are obtained, on a metallic object made cathode, uniform and fine grained zinc electrodeposits, without blisters, streaks or pitting and with a medium brilliance.

EXAMPLE 6

In the bath of example 4 there is added:

| | |
|---|---|
| Nitrogen-containing polymer solution obtained as per example 1 | 20 ml/l |
| p-Methoxybenzaldehyde | 0.1 g/l |
| Heliotropin | 0.15 g/l |

The aldehydes are utilized in the form of an alcoholic solution at 10% concentration, or in the form of an aqueous solution of their bisulfite adduct.

Under a cathodic current density of 0.1 to 8.0 A/dm$^2$ and a bath temperature of 20° to 35° C., there are obtained bright, uniform and ductile zinc electrodeposits presenting no pitting, streaks or blisters.

EXAMPLE 7

In the bath of Example 4 there is added:

| | |
|---|---|
| Nitrogen-containing polymer solution obtained as per Example 3 | 16 ml/l |
| Veratraldehyde | 0.1 g/l |
| Thiophenaldehyde | 0.1 g/l |
| 1-Benzylpyridinium-3-carboxylate | 0.05 g/l |

Bright, uniform and non pitted zinc electrodeposits are obtained under cathodic current densities of 0.1 to 9.0 A/dm$^2$.

EXAMPLE 8

In the bath of Example 4 there is added:

| | |
|---|---|
| Polymer solution obtained as per Example 2 | 3 ml/l |
| Polymer solution obtained as per Example 3 | 15 ml/l |
| p-Methoxybenzaldehyde | 0.2 g/l |
| Thiophenaldehyde | 0.05 g/l |
| Polyvinylalcohol | 0.05 g/l |

A Hull cell test is made with this bath, on a steel cathode, at 25° C. temperature, the total current being of 3 A and the plating time of 30 minutes.

There is obtained a zinc electrodeposit which is uniform, bright and ductile and without blisters, pitting or streaks, under cathodic current densities of 0.1 to 10 A/dm$^2$. This deposit is easily passivated by the current techniques.

EXAMPLE 9

In order to put in evidence the advantages of this invention compared with the known art, a Hull cell test is made with the bath of Example 4 wherein is added 3 g/l of the polymer obtained as per the German Pat. No. DT 2 412 356, namely by reacting, in a reaction vessel, 68.1 g imidazole, 300 g water and 92.0 g epichlorohydrin.

There is also added, in this bath 0.3 g anisaldehyde. The cathode is of steel, the total current is 3 A, the temperature of the bath 25° C. and the plating time 30 minutes.

There is obtained a zinc electrodeposit presenting strong pitting between cathodic current densities of 1.5 and 8.0 A/dm$^2$.

The present invention is not limited to the above examples, numerous other variants being realizable by the man of the art, by applying the formulae and methods described in this specification.

What I claim is:

1. An aqueous alkaline electroplating bath for bright zinc electrodeposition, comprising:

(a) an aqueous solution of an alkaline zincate, and (b) a sufficient amount, effective to provide bright, ductile and uniform zinc electrodeposits, of a nitrogen-containing polymer, soluble in water, and obtained by the successive chemical reactions A, B and C, as follows:

Reaction A: A heterocyclic pentagonal or hexagonal compound, comprising at least two nitrogen atoms in the aromatic ring, is reacted with a cyclic carbonate comprising carbon, hydrogen and oxygen atoms;

Reaction B: The product of the reaction A is further reacted with an epihalohydrin or an alpha-dihalohydrin, in order to obtain an intermediary, water soluble, nitrogen-containing polymer;

Reaction C: The product of reaction B is further reacted with a compound of general formula (1):

$$X\text{-}R_1\text{—}\underset{\underset{O}{\|}}{C}\text{—}O\text{—}R_2$$

wherein:

X represents a hydrogen atom or a phenyl radical;

$R_1$ represents an alkenylene, alkylene, haloalkenylene, hydroxyalkenylene or carboxy (hydroxy) alkenylene group; and $R_2$ represents a hydrogen atom or an alkyl, hydroxyalkyl, haloalkyl or halohydroxyalkyl.

2. The bath as defined in claim 1/wherein said polymer is present in solution in quantities of 0.1 to 50.0 grams per liter of bath.

3. The bath as defined in claim 1 wherein heterocyclic compound is selected from among the following compounds: imidazole, pyrrole, piperazine, benzotriazole, 1-methylimidazole, 2-methylimidazole, 1-hydroxyethylimidazole, 2-hydroxyethylimidazole, 2,4-dimethylimidazole, 2-ethylimidazole, 2-isopropylimidazole, 1-(3-aminopropyl)imidazole, and 1-ethylpiperazine.

4. The bath as defined in claim 1 wherein said epihalohydrin is epichlorohydrin.

5. The bath as defined in claim 1 wherein said cyclic carbonate is selected from the group consisting of: ethylene carbonate, propylene carbonate, glycerol carbonate, allylglycerol carbonate, 2,3-butylene carbonate, and phenylene carbonate.

6. The bath as defined in claim 1 wherein said compound of formula (1), is selected amoung the following compounds:

$Cl\text{—}CH_2\text{—}CO.ONa$, $$CH_3\text{—}\underset{\underset{Cl}{|}}{CH}\text{—}CO.O\text{—}CH_2\text{—}CH(OH)\text{—}CH_2\text{—}Cl,$$

$HO\text{—}CH_2\text{—}CO.O\text{—}CH_2\text{—}CH(OH)\text{—}CH_2\text{—}Cl$, and $CH_2(COOH)\text{—}C(OH)(COOH)\text{—}CH_2\text{—}CO.O\text{—}CH_2\text{—}CH(OH)\text{—}CH_2\text{—}Cl$.

7. The bath as defined in claim 1 wherein said polymer is obtained by the following successive reactions A, B and C:

Reaction A: Imidazole is reacted, in aqueous media, with ethylene carbonate;

Reaction B: The product of Reaction A is further reacted with epichlorohydrin; and Reaction C: The product of Reaction B is further reacted with the compound:

$$HO—CH_2—CO.O—CH_2—CH(OH)—CH_2—Cl.$$

8. The bath as defined in claim 1 and containing additionally a secondary brightener in concentration of 0.05 to 10.0 g/l.

9. The bath as defined in claim 8 wherein said secondary brightener is an aromatic aldehyde.

10. A method of bright zinc electroplating in which an object is made cathode in an electroplating bath as defined in claim 1.

11. An aqueous alkaline electroplating bath for bright zinc electrodeposition, comprising:

(a) an aqueous solution of an alkaline zincate, and (b) a sufficient amount, effective to provide bright, ductile and uniform zinc electrodeposits, of a nitrogen-containing polymer, soluble in water, and obtained by the successive chemical reactions A, B 1 and C, as follows:

Reaction A: An heterocyclic pentagonal or hexagonal compound, comprising at least two nitrogen atoms in the aromatic ring, is reacted with a cyclic carbonate comprising carbon, hydrogen and oxygen atoms;

Reaction B 1: The product of the Reaction A is further reacted with an epihalohydrin or an alpha-dihalohydrin and an aliphatic amine or polyamine, in order to obtain an intermediary, water soluble polymer;

Reaction C: The product of Reaction B 1 is further reacted with a compound of general formula (1):

$$X—R_1—\underset{\underset{O}{\|}}{C}—O—R_2 \qquad (1)$$

wherein:

X represents a hydrogen atom or a phenyl radical;

$R_1$ represents an alkenylene, alkylene, haloalkenylene, hydroxyalkenylene or carboxy (hydroxy) alkenylene group; and $R_2$ represents a hydrogen atom or an alkyl, hydroxyalkyl, haloalkyl or halohydroxyalkyl.

12. The bath as defined in claim 11 wherein said polymer is present in solution in quantities of 0.1 to 50.0 grams per liter of bath.

13. The bath as defined in claim 11 wherein said heterocyclic compound is selected from the group consisting of: imidazole, pyrrole, piperazine, benzotriazole, 1-methylimidazole, 2-methylimidazole, 1-hydroxyethylimidazole, 2-hydroxyethylimidazole, 2,4-dimethylimidazole, 2-ethylimidazole, 2-isopropylimidazole, 1-(3-aminopropyl)imidazole, and 1-ethylpiperazine.

14. The bath as defined in claim 11 wherein said cyclic carbonate is selected from the group consisting of: ethylene carbonate, propylene carbonate, glycerol carbonate, allylglycerol carbonate, 2,3-butylene carbonate, and phenylene carbonate.

15. The bath as defined in claim 11 wherein said epihalohydrin is epichlorohydrin.

16. The bath as defined in claim 11 wherein said aliphatic amine or polyamine is selected from the group consisting of: methylamine, ethylamine, dimethylamine, isopropylamine, ethylenediamine, diethylenetriamine, tetraethylenepentamine, 2-diethylaminoethylamine, and methylethanolamine.

17. The bath as defined in claim 11 wherein said compound of formula (1), is selected from among the following compounds:

$$Cl—CH_2—CO.ONa,$$

$$CH_3—\underset{\underset{Cl}{|}}{CH}—CO.O—CH_2—CH(OH)—CH_2—Cl,$$

$$HO—CH_2—CO.O—CH_2—CH(OH)—CH_2—Cl, \text{ and}$$

$$CH_2(COOH)—C(OH)(COOH)—CH_2—CO.O—CH_2—CH(OH)—CH_2—Cl.$$

18. The bath as defined in claim 11 wherein said polymer is obtained by the following successive reactions A, B 1 and C:

Reaction A: imidazole is reacted, in aqueous media, with ethylene carbonate;

Reaction B 1: The product of reaction A is further reacted with epichlorohydrin and dimethylamine;

Reaction C: The product of Reaction B 1 is further reacted with the compound:

$$HO—CH_2—CO.O—CH_2—CH(OH)—CH_2—Cl.$$

19. The bath as defined in claim 11 and containing additionally a secondary brightener in concentration of 0.05 to 10.0 g/l.

20. The bath as defined in claim 19 wherein said secondary brightener is an aromatic aldehyde.

21. A method of bright zinc electroplating in which an object is made cathode in an electroplating bath as defined in claim 11.

* * * * *

UNITED STATES PATENT AND TRADEMARK OFFICE

CERTIFICATE OF CORRECTION

PATENT NO. : 4,536,261

DATED : August 20, 1985

INVENTOR(S) : Francine Popescu

It is certified that error appears in the above-identified patent and that said Letters Patent is hereby corrected as shown below:

Column 5, line 19 after "solution" delete "remaining" and insert --resulting--.

Signed and Sealed this

*Tenth* Day of *December 1985*

[SEAL]

*Attest:*

DONALD J. QUIGG

*Attesting Officer*

*Commissioner of Patents and Trademarks*